US007568285B2

(12) United States Patent
Sexton et al.

(10) Patent No.: US 7,568,285 B2
(45) Date of Patent: Aug. 4, 2009

(54) METHOD OF FABRICATING A SELF-ALIGNED PRINT HEAD

(75) Inventors: Richard W. Sexton, Bainbridge, OH (US); Michael J. Piatt, Dayton, OH (US); Robert J. Simon, Bellbrook, OH (US)

(73) Assignee: Eastman Kodak Company, Rochester, NY (US)

( * ) Notice: Subject to any disclaimer, the term of this patent is extended or adjusted under 35 U.S.C. 154(b) by 281 days.

(21) Appl. No.: 11/382,787

(22) Filed: May 11, 2006

(65) Prior Publication Data

US 2007/0263042 A1 Nov. 15, 2007

(51) Int. Cl.
*B41J 2/16* (2006.01)

(52) U.S. Cl. ..... 29/890.1; 29/846; 216/27; 347/54; 347/47

(58) Field of Classification Search ..... 29/890.1, 29/25.35, 611, 846; 216/27; 205/75; 174/254; 347/54, 57, 63, 67–71, 73, 82, 44, 47
See application file for complete search history.

(56) References Cited

U.S. PATENT DOCUMENTS

| | | | |
|---|---|---|---|
| 3,984,843 | A | 10/1976 | Kuhn |
| 4,047,184 | A | 9/1977 | Bassous et al. |
| 4,106,975 | A | 8/1978 | Berkenblit et al. |
| 4,184,925 | A | 1/1980 | Kenworthy |
| 4,213,238 | A | 7/1980 | Gudorf |
| 4,223,320 | A | 9/1980 | Paranjpe et al. |
| 4,271,589 | A | 6/1981 | Gudorf |
| 4,277,548 | A | 7/1981 | Vedder |
| 4,334,232 | A | 6/1982 | Head |
| 4,347,522 | A | 8/1982 | Bahl et al. |
| 4,373,707 | A | 2/1983 | Molders |

(Continued)

FOREIGN PATENT DOCUMENTS

| | | |
|---|---|---|
| EP | 0 938 079 | 8/1999 |

(Continued)

OTHER PUBLICATIONS

T. Diepold et al., A Micromachined Continuous Ink Jet Print Head for High-Resolution Printing, J. Micromech. Microeng. 8, 1998, pp. 144-147.

(Continued)

*Primary Examiner*—A. Dexter Tugbang
(74) *Attorney, Agent, or Firm*—William R. Zimmerli

(57) ABSTRACT

An orifice array plate and a charge plate for a continuous ink jet printer print head are integrally fabricated by providing an electrically non-conductive substrate; forming, on one side of the substrate, an orifice plate with an array of orifices; forming, on the other side of the substrate, a charge plate comprising a plurality of charge leads aligned with respective ones of the orifices; and removing at least that portion of the substrate that is between the orifices and the charge leads. The final produce includes an electrically non-conductive substrate; an orifice plate, including an array of orifices, on one side of the substrate; a charge plate, including a plurality of charge leads, on the other side of the substrate such that the charge leads are aligned with respective ones of the orifices; and a plurality of passages through the substrate, said passages extending between the orifices and the charge leads.

1 Claim, 5 Drawing Sheets

U.S. PATENT DOCUMENTS

| | | | | |
|---|---|---|---|---|
| 4,374,707 | A | 2/1983 | Pollack | |
| 4,378,631 | A | 4/1983 | Head et al. | |
| 4,560,991 | A | 12/1985 | Schutrum | |
| 4,636,808 | A | 1/1987 | Herron | |
| 4,678,680 | A | 7/1987 | Abowitz | |
| 4,894,664 | A | 1/1990 | Tsung Pan | |
| 4,928,113 | A | 5/1990 | Howell et al. | |
| 4,972,201 | A | 11/1990 | Katerberg et al. | |
| 4,972,204 | A | 11/1990 | Sexton | |
| 4,999,647 | A | 3/1991 | Wood et al. | |
| 5,084,345 | A * | 1/1992 | Manos | 174/254 X |
| 5,167,776 | A * | 12/1992 | Bhaskar et al. | 205/75 |
| 5,455,611 | A | 10/1995 | Simon et al. | |
| 5,475,409 | A | 12/1995 | Simon et al. | |
| 5,512,117 | A | 4/1996 | Morris | |
| 5,559,539 | A | 9/1996 | Vo et al. | |
| 5,604,521 | A | 2/1997 | Merket et al. | |
| 5,820,770 | A | 10/1998 | Cohen et al. | |
| 6,164,759 | A | 12/2000 | Fujii et al. | |
| 6,280,643 | B1 * | 8/2001 | Silverbrook | 216/27 |
| 6,375,310 | B1 | 4/2002 | Arakawa et al. | |
| 6,431,682 | B1 | 8/2002 | Osada et al. | |
| 6,464,892 | B2 | 10/2002 | Moon et al. | |
| 6,474,795 | B1 * | 11/2002 | Lebens et al. | 347/82 |
| 6,545,406 | B2 | 4/2003 | Hofmann et al. | |
| 6,560,991 | B1 | 5/2003 | Kotliar | |
| 6,627,096 | B2 | 9/2003 | Sherrer et al. | |
| 6,635,184 | B1 | 10/2003 | Cohen et al. | |
| 6,660,614 | B2 | 12/2003 | Hirschfeld et al. | |
| 6,739,703 | B2 * | 5/2004 | Higuchi et al. | 347/70 |
| 6,759,309 | B2 | 7/2004 | Gross | |
| 2002/0000516 | A1 | 1/2002 | Schultz et al. | |
| 2002/0000517 | A1 | 1/2002 | Corso et al. | |
| 2002/0063107 | A1 | 5/2002 | Moon et al. | |
| 2003/0022397 | A1 | 1/2003 | Hess et al. | |
| 2003/0054645 | A1 | 3/2003 | Sheldon | |
| 2003/0066816 | A1 | 4/2003 | Schultz et al. | |
| 2003/0073260 | A1 | 4/2003 | Corso | |

FOREIGN PATENT DOCUMENTS

| | | | |
|---|---|---|---|
| EP | 1 020 291 | 1/2000 | |
| FR | 2 698 584 | 11/1992 | |
| JP | 06031920 A * | 2/1994 | 29/890.1 |

OTHER PUBLICATIONS

J. Smith et al., Continuous Ink-Jet Print Head Utilizing Silicon Micromachined Nozzles, Sensors and Actuators A, 43, 1994, pp. 311-316.

Rhonda Renee Myers, Novel Devices for Continuous-on-Demand Ink jet Deflection Technologies, B.S.E.E., University of Cincinnati, Nov. 17, 2005.

* cited by examiner

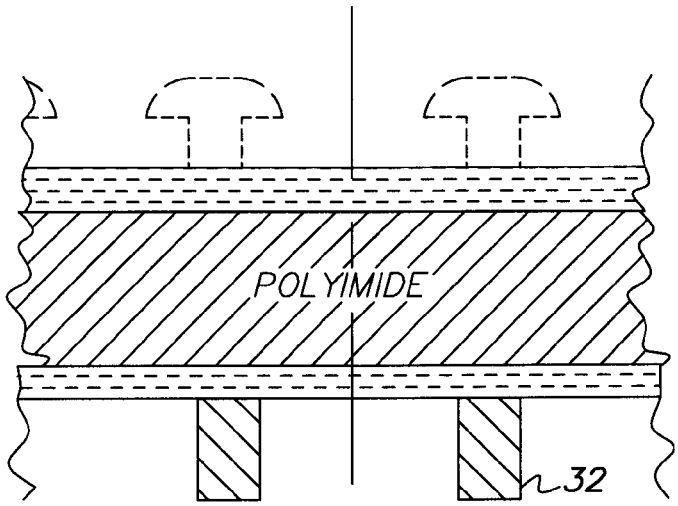
FIG. 3B
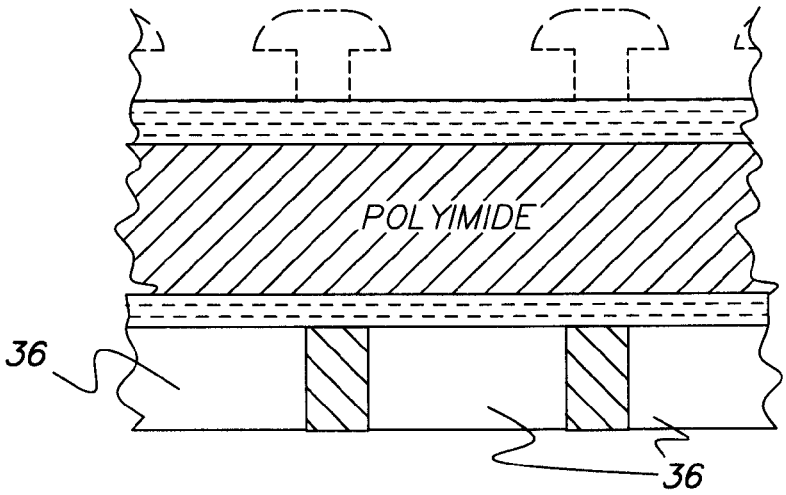
FIG. 3C
FIG. 3D
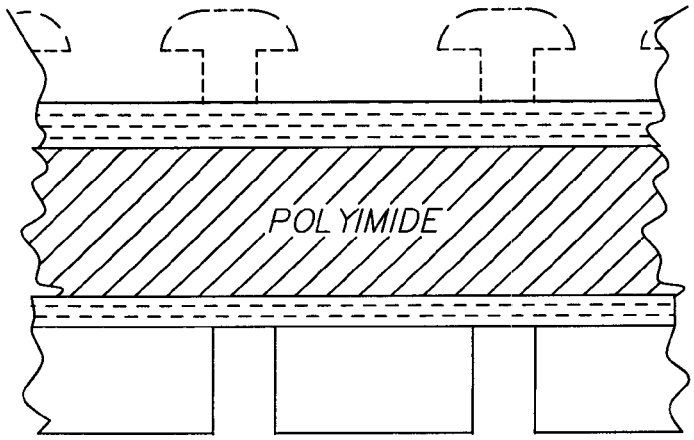

METHOD OF FABRICATING A SELF-ALIGNED PRINT HEAD

CROSS REFERENCE TO RELATED APPLICATIONS

Reference is made to commonly assigned, co-pending U.S. patent application Ser. No. 11/382,773 CHARGE PLATE AND ORIFICE PLATE FOR CONTINUOUS INK JET PRINTERS to Richard W. Sexton, Ser. No. 11/382,726 entitled ELECTROFORMED INTEGRAL CHARGE PLATE AND ORIFICE PLATE FOR CONTINUOUS INK JET PRINTERS to Shan Guan et al. and Ser. No. 11/382,759 entitled INTEGRATED CHARGE AND ORIFICE PLATES FOR CONTINUOUS INK JET PRINTERS to Shan Guan et al. filed concurrently herewith.

FIELD OF THE INVENTION

The present invention relates to continuous ink jet printers, and more specifically to the fabrication of an orifice plate and a charge plate for such printers.

BACKGROUND OF THE INVENTION

This invention relates to continuous-type ink jet printing systems, which create printed matter by selective charging, deflecting, and catching drops produced by one or more rows of continuously flowing ink jets. The jets themselves are produced by forcing ink under pressure through an array of orifices in an orifice plate. The jets are stimulated to break up into a stream of uniformly sized and regularly spaced droplets. The approach for printing with these droplet streams is to selectively charge and deflect certain drops from their normal trajectories.

A charge plate accomplishes droplet charging. The charge plate has a series of charging electrodes located equidistantly along one or more straight lines. Each charging electrodes is formed with an electrically conductive material. Electrical leads are connected to each such charge electrode, and the electrical leads in turn are activated selectively by an appropriate data processing system.

U.S. Pat. No. 4,636,808, which issued to Herron, describes a simple arrangement of the drop generator and the charge plate, but the orifice plate attached to the drop generator and the charge electrodes require careful mechanical alignment and fixation so that the charge electrodes align exactly with corresponding jets issuing from the orifice plate. If the jets are misaligned or become misaligned in use, the quality of printing is adversely affected. Misalignment of as little as 10 micrometers can cause rejection of the print head and require it to be refurbished. Matching of the dimensions of the ink jet array and the charge electrode array becomes problematic, especially for page-wide arrays where there are thousands of ink jets and charge electrodes.

Conventional and well-known processes for making the orifice plate and charge plate separately consist of photolithography and nickel electroforming. Orifice plate fabrication methods are disclosed in U.S. Pat. No. 4,374,707; No. 4,678,680; and No. 4,184,925. The commonality of these and other patents is in the deposition of a nonconductive thin disk onto a substrate, which is followed by partial coverage of this with nickel to form an orifice. In the prior art process, a conductive substrate of solid metal is used to hold the thin disk and the plating. After formation of the orifice, the metal substrate is selectively etched away leaving the orifice plate electroform as a single component. Charge plate electroforming is described in U.S. Pat. No. 4,560,991 and No. 5,512,117. These charge plates are made by depositing nonconductive traces on a metal substrate followed by deposition of nickel in a similar fashion to orifice plate fabrication, except that parallel lines of metal are formed instead of orifices.

Accordingly, it is an object of the present invention to provide a simplified and more accurate method for fabrication of the orifice plate and charge plate. It is another object of the present invention to provide such an aligned orifice plate and charge plate as one, self-aligned component.

SUMMARY OF THE INVENTION

According to a feature of the present invention, fabrication of the orifice plate and charge plate are carried out on opposite sides of the same substrate platform such that the one is optically aligned to the other in sequential steps that ensure self-alignment of the two components. That is, the orifice plate and charge plate are made in a single piece.

According to another feature of the present invention, an orifice array plate and a charge plate for a continuous ink jet printer print head are integrally fabricated by providing an electrically non-conductive substrate; forming, on one side of the substrate, an orifice plate with an array of orifices; forming, on the other side of the substrate, a charge plate comprising a plurality of charge leads aligned with respective ones of the orifices; and removing at least that portion of the substrate that is between the orifices and the charge leads.

According to yet another feature of the present invention, an integrally fabricated orifice array plate and charge plate for a continuous ink jet printer print head includes an electrically non-conductive substrate; an orifice plate, including an array of orifices, on one side of the substrate; a charge plate, including a plurality of charge leads, on the other side of the substrate such that the charge leads are aligned with respective ones of the orifices; and a plurality of passages through the substrate, said passages extending between the orifices and the charge leads.

In a preferred embodiment of the present invention, the substrate is a smooth sheet of flexible dielectric material. A layer of conductive metal is between the substrate and each of the plates. At least that portion of the metal coatings that is between the orifices and the charge leads has been removed. The dielectric material is polyimide.

BRIEF DESCRIPTION OF THE DRAWINGS

FIGS. 3A-3D are front cross-sectional views of the substrate of FIG. 1 showing the steps of fabrication of a charge plate thereon;

DETAILED DESCRIPTION OF THE INVENTION

It will be understood that the orifice array plate and the charge plate of the present invention are intended to cooperate with otherwise conventional components of ink jet printers that function to produce the desired streams of uniformly sized and spaced drops in a highly synchronous condition. Other continuous ink jet printer components, e.g. drop ejection devices, deflection electrodes, drop catcher, media feed system, and data input and machine control electronics (not shown) cooperate to effect continuous ink jet printing. Such devices may be constructed to provide synchronous drop streams in a long array printer, and are comprised in general of a resonator/manifold body to which the orifice plate is bonded, a plurality of piezoelectric transducer strips, and transducer energizing circuitry.

Figure 1:
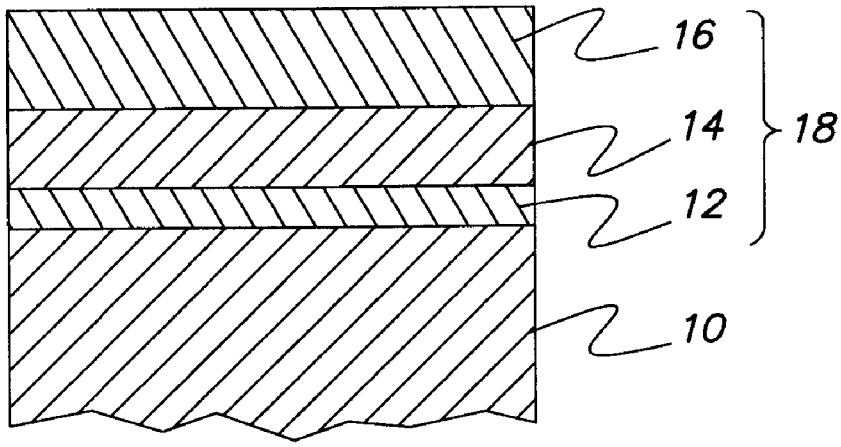
FIG. 1 is a cross-sectional view of a dielectric substrate and metal coating usable in the present invention.
Figure 2A:
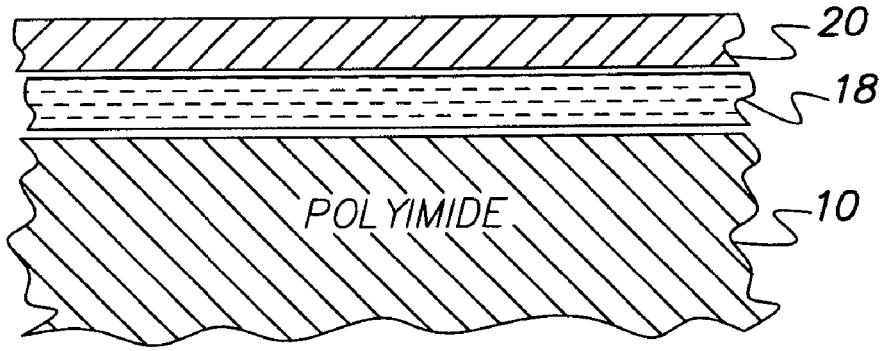
FIG. 2A-2D are cross-sectional views of the substrate of FIG. 1 showing the steps of fabrication of an orifice plate thereon.
Figure 2B:
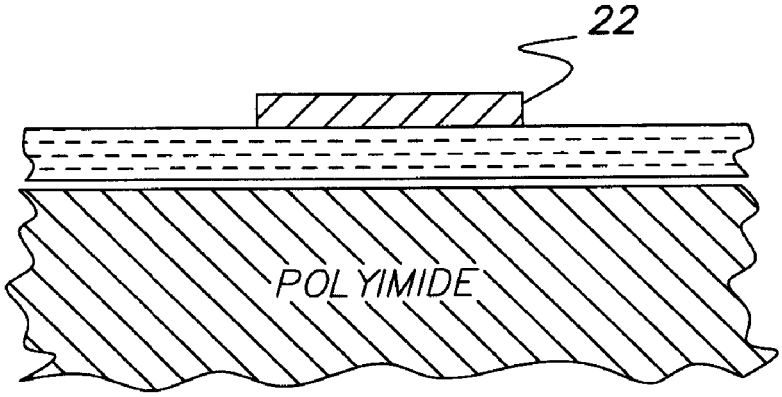
Figure 2C:
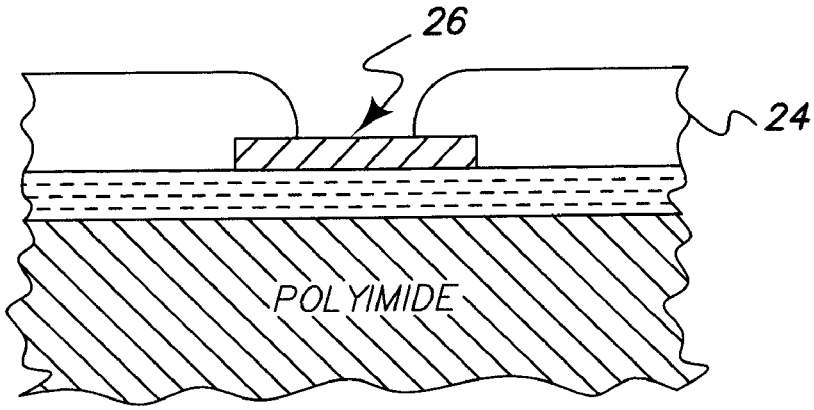
Figure 2D:
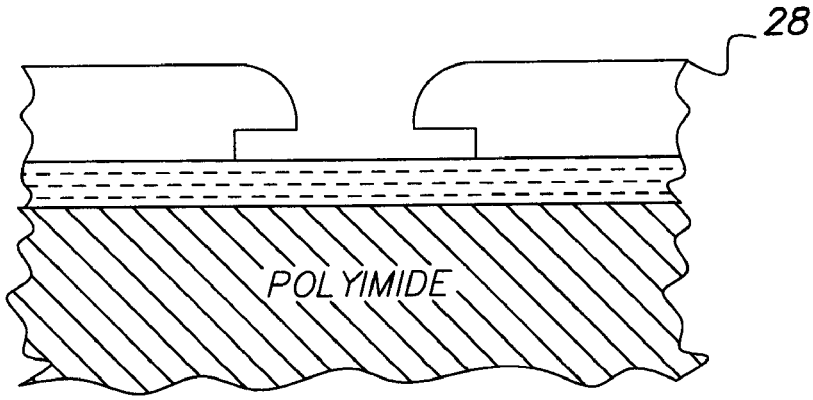
Figure 5:
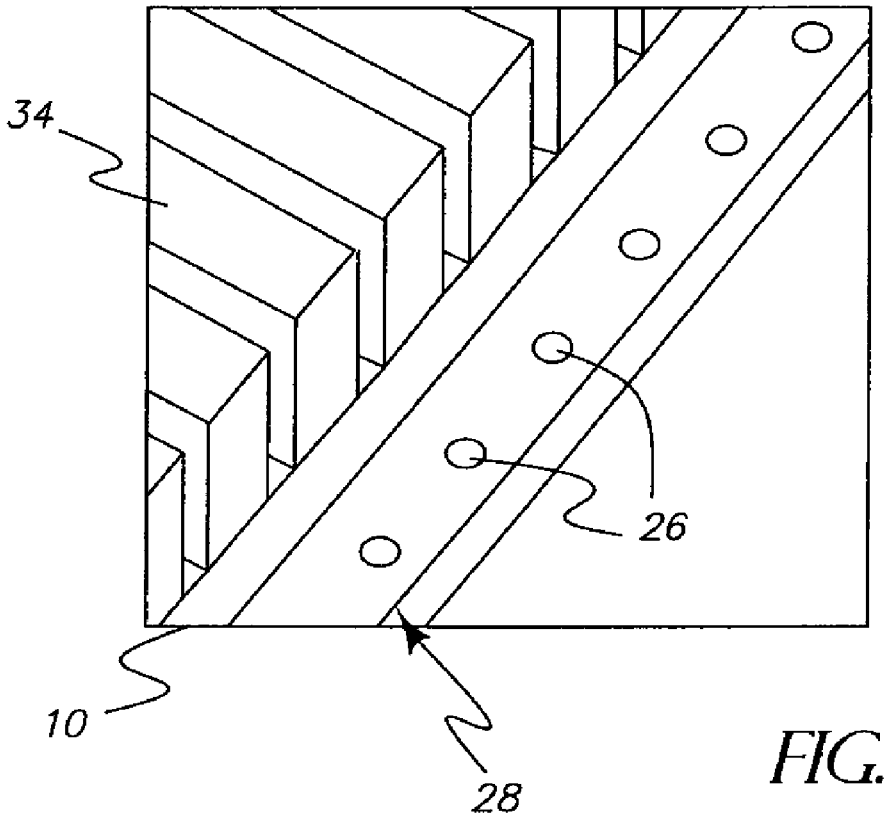
FIGS. 5 and 6 are perspective cross-sectional views of the structure of FIG. 4.
Figure 6:
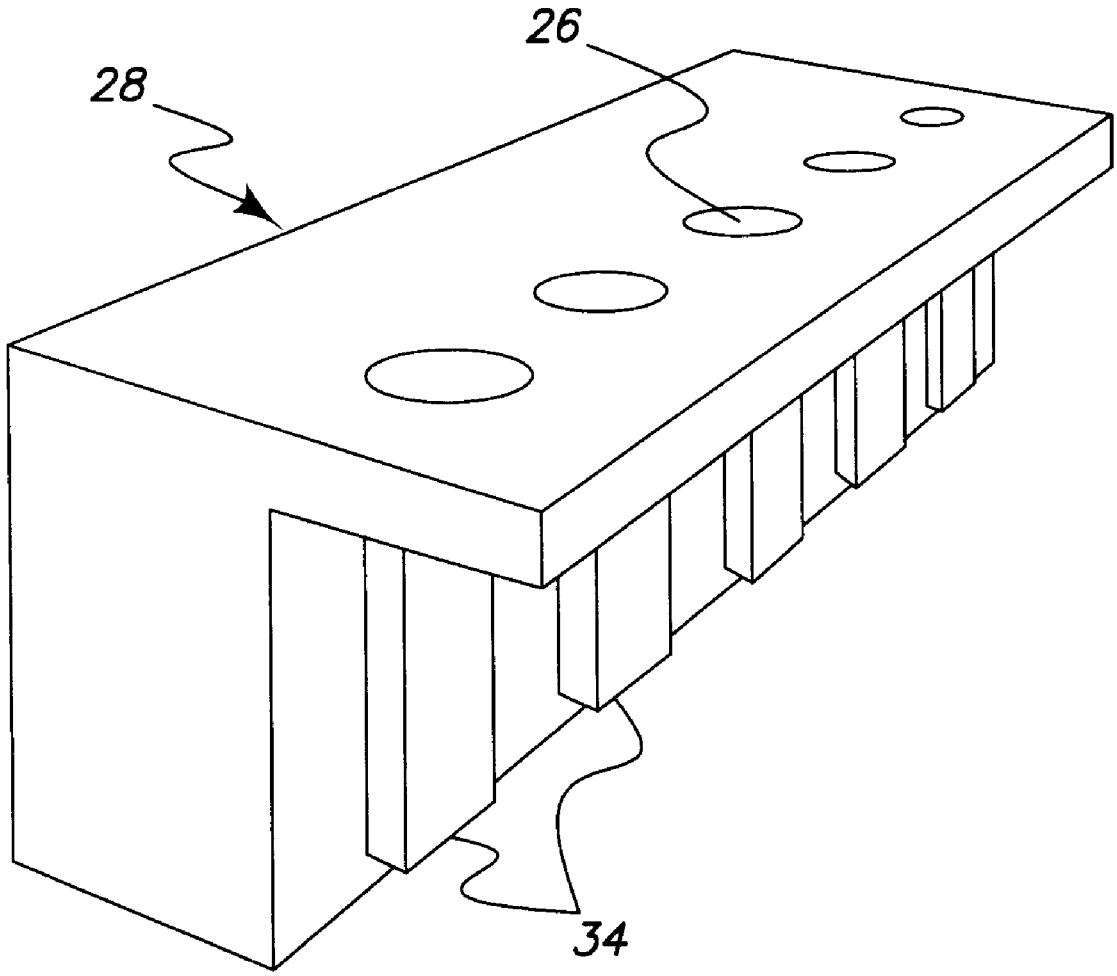

FIG. 1 shows a sheet of smooth, flexible dielectric polyimide substrate 10, which is coated on both sides with thin layers of conductive metal coatings 12, 14, and 16. In the illustrated embodiment, the substrate 10 is commercially available from the Gould Corporation and the conductive metal coating layers comprise a tiecoat 12 of Monel™ and chromium, a vacuum metallized copper seedcoat 14, and electrodeposited copper 16. The metal coatings 12, 14, and 16 are referenced collectively by the numeral 18 in the drawings and are referred to as a "conductive metal layer". They allow electroplating of orifice plate 28 and charge plate comprising charge leads 34 (FIGS. 5 and 6). Polyimide is an example of a suitable material for the substrate, but other dielectric materials that can be coated with metal could be used. The primary requirements are that the substrate be dimensionally stable, capable of being coated with a conductive layer, and is not degraded by exposure to ink or other fluids to be used in the ink jet printer. Preferably, the substrate is capable of ultimately being etched or otherwise selectively removed in the presence of nickel electroformed plates. FIG. 1 shows only one side of the sheet, but the opposite side is coated in a like manner to permit deposition of the charge plate.

FIGS. 2 through 5 describe a preferred process for practicing the invention to thereby fabricate a self-aligned orifice plate/charge plate structure. These figures are simplified for clarity. For example, only one orifice is shown in FIG. 2, but it will be understood that, in practice, the number of orifice can equal any desired number. Referring first to FIG. 2A, a substrate 10 with conductive metal layer 18, such as shown in FIG. 1, is coated on one side with a photoresist 20. The photoresist is imagewise exposed through a mask (not shown) and developed to leave a raised disc 22 of circular cross sectional, as illustrated in FIG. 2B. This is a well known method for electroformed precursors, as is described in the above-referenced patents. FIG. 2C shows the addition of electroplated nickel 24 which partially over plates the disk. When the photoresist discs are removed, as shown in FIG. 2D, the electroplated nickel forms an orifice plate 28 with series of orifices 26; as is well known in the art. The orifice plate is still supported by the substrate.

Figure 3A:
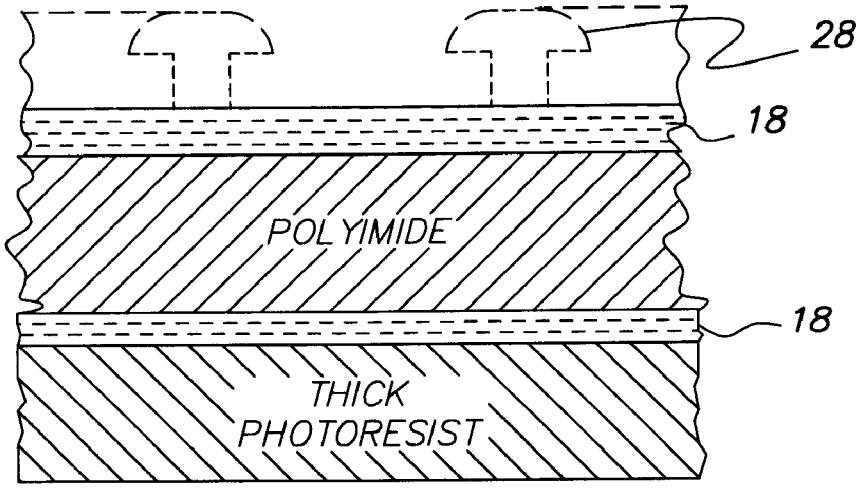

After the orifice plate 28 has been formed on one side of the substrate, a charge plate is formed on the opposite side of the substrate, as shown in FIGS. 3A through 3D. An effective method for making charge plates is to use photoresist molds as described in the above patent literature, and this method is especially useful for the present invention. In FIG. 3A, the surface of the metallized substrate opposite the orifice plate 28 is covered with a film of photoresist material 30. An image of the charge plate lines, aligned to the orifice plate on the opposite side, is photoprinted into the resist. This is best accomplished on a mask aligner that has an image memory alignment feature, such as the Karl Suess double-sided mask aligner. This equipment stores a video image of the orifice plate top surface, and then the bottom mask (i.e., the charge plate) is accurately moved into alignment with respect to that image. Critical registration distances are shown as "X" and "Y" in FIG. 4. The Z axis registration, perpendicular to "X" and "Y", is also critical. The "Y" distance, commonly know and the "charge plate gap" is controlled by the thickness of the substrate 10. The "X" dimension, commonly known as setback, and the registration in the "Z" direction are established by the design of the top and bottom masks used in the photolith process and by the registration achieved using the mask aligner. The dimensions of "X" and "Z", the self-alignment criteria, can easily be held to within a few micrometers using a mask aligner with good optics, such as the Karl Suess machine. After the photoresist is imagewise exposed through the mask, it is developed to leave a raised pattern of mold lines 32, as illustrated in FIG. 3B. FIG. 3C shows nickel 34 electroplated onto the conductive metal layer between the mold lines formed by the photoresist to form charge leads. In FIG. 3D the photoresist mold lines 32 have been removed, showing the ends of the electroformed charge leads 34, aligned with orifices 26 above. The array of charge leads forms a charge plate.

Because the substrate is electrically non-conductive, the substrate can remain as part of the orifice plate/charge plate structure. This would not be possible with the conventional methods because the charge electrodes are held at about 100 volts with respect to the orifice plate/drop generator. The old methods used conductive, solid metal sheets as substrates, and if so used in the present invention would cause electrical shorting of orifice plate 28 and charge leads 34.

Figure 4:
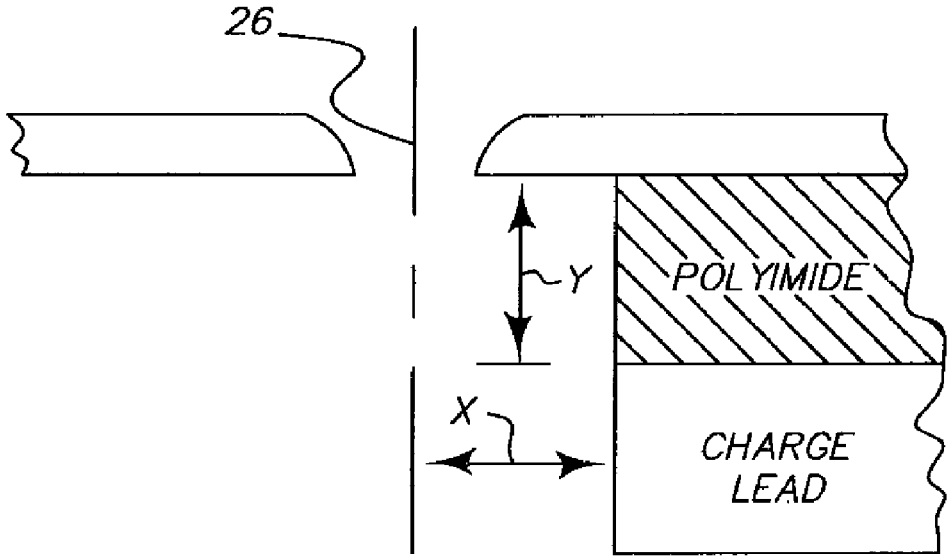
FIG. 4 is a side cross-sectional view of the substrate of FIG. 1, the orifice plate of FIG. 2D, and the charge plate of FIG. 3D showing registration distances.

In order for ink to issue from the orifices, a portion of dielectric substrate 10 must be removed from between orifice plate 28 and charge plate 34. FIG. 4 illustrates this process, which is readily accomplished by means of an ultraviolet laser or by a sodium hydroxide aqueous etching solution. These methods are capable of destroying polyimide while being innocuous to nickel. The thin metal coating layers 12, 14, and 16 (usually copper based) are then removed with a selective etchant, such as aqueous ammonium persulfate. This is a known process used for etching copper printed circuit boards. This selective etching process must remove not only the thin metal coating layer around each of the ink ejecting orifices 26 but also between the charge leads 34. Failure to adequately remove the metal layer between charge leads will produce lead-to-lead shorts.

After the thin metal coating layer is removed from between the charge leads, it is desirable to fill the space between the charge leads with a non-conductive material. This non-conductive material prevents conductive ink from filling the space between charging leads where it can produce lead-to-lead electrical shorts. This non-conductive material may be an epoxy or other appropriate material that won't break down due to exposure to the ink or due to the electrical fields produced between charging leads.

A schematic perspective view of the completed orifice plate/charge plate integrated structure is shown in FIGS. 5 and 6. This structure can then be mounted to ink jet manifolds in the usual manner that orifice plates, alone, are mounted, such as described in aforementioned U.S. Pat. No. 4,999,647. No tedious registration of orifices to the charging electrodes of the charge plate is required because the charge plate is now integral and self-aligned with the orifice plate.

The invention has been described in detail with particular reference to certain preferred embodiments thereof, but it will be understood that variations and modifications can be effected within the spirit and scope of the invention.

PARTS LIST

10—Substrate, electrically non-conductive
12—Tiecoat

14—Seedcoat
16—copper
18—layer of conductive metal
20—photoresist
22—disc of photoresist
24—electroplated nickel
26—orifices
28—orifice plate
30—photoresist
32—mold lines
34—charge leads, electroplated nickel

The invention claimed is:

1. A method for integrally fabricating an orifice array plate and a charge plate for a continuous ink jet printer print head, said method comprising the steps of:

providing an electrically non-conductive substrate, wherein the electrically non-conductive substrate includes one side and the other side opposite to the one side;

providing a layer of conductive metal on the one side and on the other side of the electrically non-conductive substrate;

forming, on the one side of the electrically-nonconductive substrate, an orifice plate with an array of orifices;

forming, on the other side of the electrically-nonconductive substrate, an ink droplet charging charge plate comprising respective ink droplet charging charge leads each aligned with a corresponding one of the orifices; and further comprising a step of removing portions of the layer of conductive metal from around each of the orifices and between the ink droplet charging charge leads.

* * * * *